United States Patent [19]

Robertson

[11] 4,160,869

[45] Jul. 10, 1979

[54] CONTINUOUS CHARGING APPARATUS

[75] Inventor: Andrew D. Robertson, Rotherham, England

[73] Assignee: British Steel Corporation, London, England

[21] Appl. No.: 856,222

[22] Filed: Dec. 1, 1977

[30] Foreign Application Priority Data

Dec. 2, 1976 [GB] United Kingdom ..... 50306/76

[51] Int. Cl.[2] ..... F27D 3/16

[52] U.S. Cl. ..... 13/33; 414/160

[58] Field of Search ..... 13/9, 33, 31; 214/18 R, 214/18 SC, 35 R

[56] References Cited

U.S. PATENT DOCUMENTS 1,193,783 8/1916 Hillhouse ..... 13/33 UX 2,744,944 5/1956 Striplin, Jr. et al. ..... 13/33 X 3,634,592 1/1972 Pantke ..... 13/33

FOREIGN PATENT DOCUMENTS 1310214 3/1973 United Kingdom.

*Primary Examiner*—R. N. Envall, Jr.

*Attorney, Agent, or Firm*—Bacon & Thomas

[57] ABSTRACT

This invention relates to continuous charging apparatus and in particular provides a gravity feed chute (8,9) for the particulate feedstock secured to the furnace roof (1) and which communicates with the internal furnace area. In order to prevent the furnace gases passing into the atmosphere through this chute a number of pipes (10,11) are provided which extend into the chute for injecting steam or other gases therein, so as to contain the furnace gases.

16 Claims, 3 Drawing Figures

CONTINUOUS CHARGING APPARATUS

This invention relates to apparatus for continuously charging particulate feedstock into an electric arc furnace.

Unlike batch charging of an electric arc furnace, where the melting cycle is interrupted and the roof is removed for access, continuous charging is effected during the operation of the furnace so there is a problem in containing the furnace gases under positive furnace pressure conditions and preventing their access into the atmosphere through the charging port before during and after feeding.

It is an object of this invention to mitigate this problem.

From one aspect the present invention provides apparatus for continuously charging particulate feedstock into an electric arc furance, comprising a gravity feed chute for the feedstock secured to the furnace housing and communicating with the interior thereof, and pipes extending into the chute for injecting steam or other gases therein at such a pressure as to create a momentum flux in the chute exceeding the blow-out force of the furnace gases.

Preferably, the chute is secured to the furnace roof and is flared outwardly at its upper end and communicates with a further chute spaced apart from it for receiving the particulate feedstock from a conveyor structure, the pipes extending downwardly into the chute and being directed towards the axis thereof.

The pipes may extend into either the flared or the nonflared (lower) section and for convenience of access the pipes may extend into one side only of the chute, and two pipes may be provided, one above the other; alternatively however, two pipes may be provided extending into opposite sides of the chute. The chute may be cranked such that the axis of the section extending from the roof makes a shallower angle with the plane of the roof port than the axis of the flared section.

In order that the invention may be fully understood, one embodiment thereof will now be described, by way of example, with reference to the accompanying drawings, in which.

Figure 1:
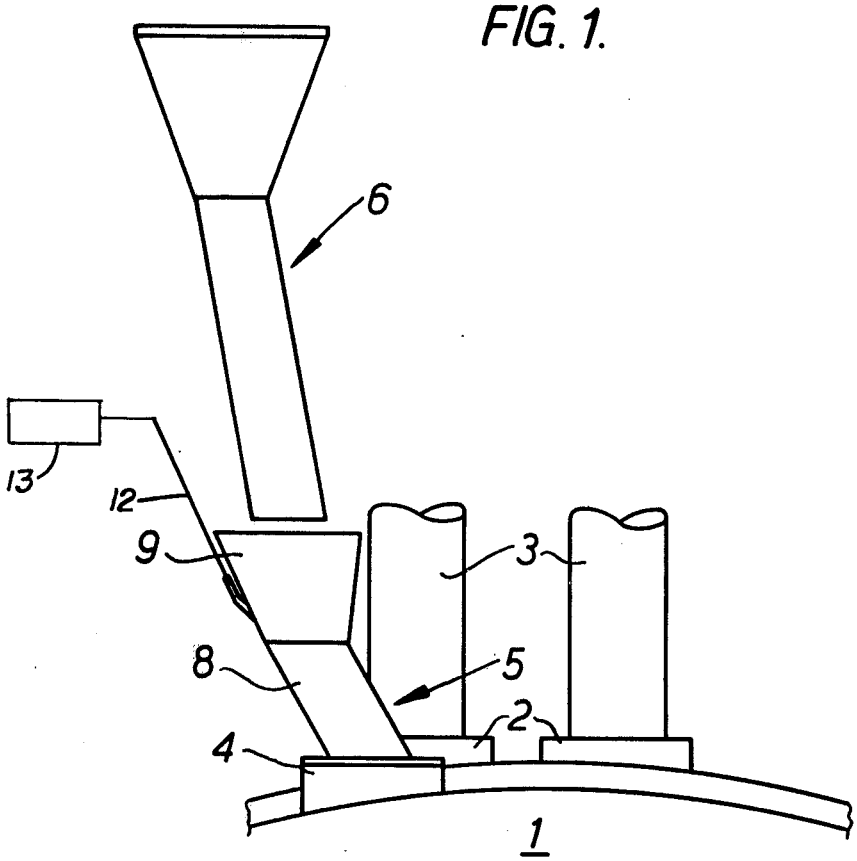
FIG. 1 is a side elevation of apparatus according to this invention.
Figure 2:
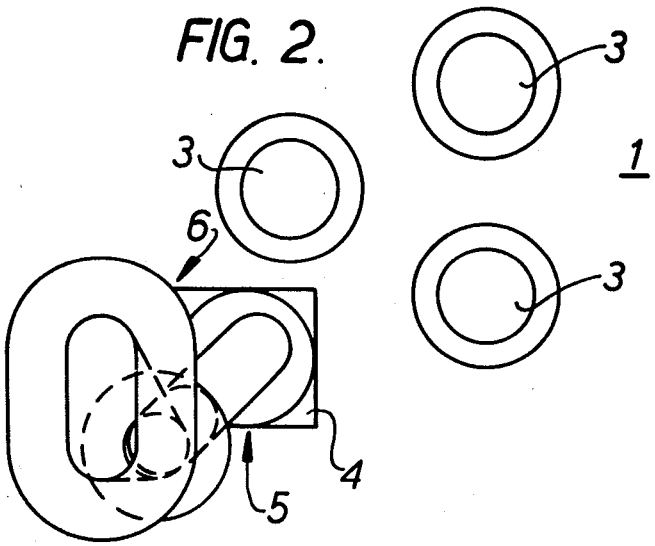
FIG. 2 is a plan view of FIG. 1.

Referring now to FIGS. 1 and 2 in the drawings a roof 1 of an arc furnace has three electrode ports 2 through which electrodes 3 depend and a port 4, offset from the pitch circle diameter of the electrodes, from which extends a chute 5. The chute 5 is surmounted by a further chute 6 which receives particulate charge material from a conveyor, not shown. Both chutes are 'cranked' to some degree so as to avoid interference with other furnace equipment, and the upper chut 6 tapers downwardly from an ovaloid funnel to a circular section whereby to gather and feed the charge more readily.

The lower chute 5 includes a duct 8 and a funnel 9 and steam feed pipes 10, 11 extend downwardly into the latter.

Figure 3:
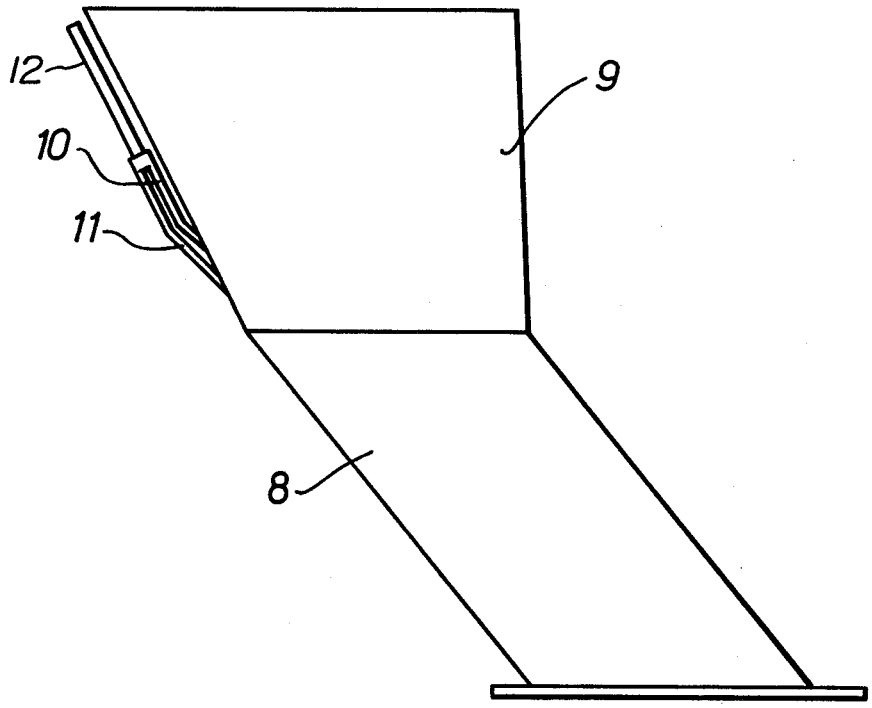
FIG. 3 is an enlarged view of the feed chute in these Figures.

More particularly, the pipes 10, 11 (FIG. 3) extend from a single feed pipe 12, a steam or other pressurized gas source 13, and both pipes 10, 11 lie in a common plane containing the axes of the duct and the funnel, the axes of the pipes 10 and 11 making a small angle with one another.

As mentioned the object of this invention is to prevent the furnace gases from issuing through the open feed port for the continuously charged material, and it has been found that the configuration of the steam pipes shown provides a uniform downward flow over the whole cross-section of the duct 8.

In particular, the tendency for furnace gases to blow-out through the chute is due to the furnace pressure at roof level being greater than atmospheric.

The blow-out force is calculated as $$F = P.A. \text{ Newtons}$$

where

P is the furnace pressure, relative to atmosphere, at roof level, and

A is the cross-sectional area of the duct 8 and this steam seal facility operates on the principle of generating a momentum flux which exceeds this blow-out force, where momentum flux is calculated as $$G = M.U$$

where

M is the jet mass flow, and

U is the jet exit velocity at the nozzle.

In the example shown each of the pipes 10, 11 has an internal diameter of the order of 9 mm., the steam issuing into the duct 8 having a diameter of about 460 mm. The consumption of steam is assessed at $31 \times 10^{-3}$ kg/sec. at a gauge pressure of 100 kN/meter$^2$ against a typical furnace pressure of 25 N/meter$^2$. It is of course necessary to maintain a high flow value to accommodate surges in the furnace pressure, especially during periods of inadequate direct extraction.

The steam jets are sited in the example shown in such a manner as to provide a uniform flow across the whole cross-section but it will be understood that other pipe configuration could equally well fulfil this function, e.g. two pipes may extend downwardly at an angle into the duct 8 from opposite sides thereof. Furthermore, other gases can be used, e.g. compressed air, but steam is preferred because of its ready availability, cheapness and, moreover, because its sonic velocity is much higher than that for air so that it generates the same momentum flux at a much reduced mass flow. Thus, if air were to be used a larger tube would be required to generate the same momentum to accommodate the higher mass flow.

For convenience the steam will normally be applied continuously during the furnace operation, but a mechanical seal may alternatively be provided during periods in which continuous charging is not being performed.

The gap between the funnel 9 and the chute 6 is provided to enable the roof 1 to be raised and swung away for batch charging etc. and to accommodate the furnace tilt on tapping, but alternatively these feed members may be in close proximity, separation being effected by mechanical or other means whenever required.

We claim:

1. Apparatus for continuously charging particulate feedstock into an electric arc furnace normally containing furnace gases under positive pressure, comprising a furnace housing, a gravity feed chute for the feedstock secured to the furnace housing to form a closed fluid flow path and communicating with the furnace interior, and means for supplying steam or other gases in said feed chute at a mass flow rate and velocity sufficient to create a momentum flux in the chute exceeding the blowout force in the chute of the furnace gases.

2. Apparatus according to claim 1, in which the furnace housing comprises the furnace roof and in which the chute is secured at its lower end to the said roof.

3. Apparatus according to claim 2, in which the chute is flared at its upper end.

4. Apparatus as recited in claim 1, wherein said means for supplying steam or other gases comprises a plurality of pipes providing communication between a source of steam or other gases and the interior of said feed chute.

5. Apparatus according to claim 4, in which the pipes extend downwardly into the chute, directed towards the axis thereof.

6. Apparatus according to claim 5, in which there are two of said pipes.

7. Apparatus according to claim 6, in which the two pipes are sited one above the other on one side only of the chute.

8. Apparatus according to claim 4, in which there are two pipes, one pipe above the other, and in which the two pipes extend into the upper end of the chute, the upper end of the chute being flared, said furnace housing comprising a furnace roof, and said chute being secured at its lower end to said roof.

9. Apparatus according to claim 7, in which the two pipes extend into opposite sides of the chute.

10. Apparatus according to claim 9, in which the two pipes extend into the lower end of the chute.

11. Apparatus according to claim 1, in which air is injected as a said gas.

12. Apparatus according to claim 11, in which the first chute is cranked.

13. Apparatus for continuously charging particulate feedstock into an electric arc furnace from a conveyor structure, comprising a furnace housing normally containing furnace gases under positive pressure, a first gravity feed chute for the feedstock secured to the furnace housing to form a closed fluid flow path and communicating with the furnace interior, a second gravity feed chute spaced apart from said first chute for receiving said feedstock from the conveyor, and means for injecting steam at a mass flow rate and velocity sufficient to create a momentum flux in the chute exceeding the blowout force in the chute of the furnace gases, said steam injecting means comprising a plurality of pipes providing communication between a source of steam and said chute.

14. Apparatus according to claim 13, in which the pipes extend downwardly into the first chute, directed towards the axis thereof.

15. A method of charging particulate feedstock into an electric arc furnace normally containing furnace gases under positive pressure comprising:

(a) charging the feedstock through an enclosed chute forming a closed flow path into the furnace interior;

(b) supplying steam or other gases into the chute at a mass flow rate and velocity sufficient to create a momentum flux in the chute exceeding the blowout force in the chute of the furnace gases.

16. The method according to claim 15, including supplying the steam or other gases through a pair of supply pipes and discharging said steam or other gases into the chute at an inclined angle with respect to the longitudinal axis of the chute and towards the furnace interior.

* * * * *